US009803146B2

(12) United States Patent
Kumar et al.

(10) Patent No.: US 9,803,146 B2
(45) Date of Patent: Oct. 31, 2017

(54) HYDROCARBON RESIDUE UPGRADATION PROCESS

(71) Applicant: HINDUSTAN PETROLEUM CORPORATION LTD., Mumbai (IN)

(72) Inventors: Pramod Kumar, Bangalore (IN); Madan K. Kumar, Bangalore (IN); Venkata Chalapathi Rao Peddy, Bangalore (IN); Venkateswarlu Choudary Nettem, Bangalore (IN); Sri Ganesh Gandham, Bangalore (IN)

(73) Assignee: Hindustan Petroleum Corporation Ltd., Mumbai (IN)

( * ) Notice: Subject to any disclaimer, the term of this patent is extended or adjusted under 35 U.S.C. 154(b) by 21 days.

(21) Appl. No.: 14/898,378

(22) PCT Filed: Aug. 27, 2013

(86) PCT No.: PCT/IN2013/000520
§ 371 (c)(1),
(2) Date: Dec. 14, 2015

(87) PCT Pub. No.: WO2014/199389
PCT Pub. Date: Dec. 18, 2014

(65) Prior Publication Data

US 2016/0137931 A1 May 19, 2016

(30) Foreign Application Priority Data

Jun. 14, 2013 (IN) ..... 2029/MUM/2013

(51) Int. Cl.

| | |
|---|---|
| ***C10G 11/02*** | (2006.01) |
| ***C10G 11/06*** | (2006.01) |
| ***C10G 55/06*** | (2006.01) |
| ***C10G 51/02*** | (2006.01) |
| ***C10G 9/00*** | (2006.01) |
| ***C10G 47/34*** | (2006.01) |
| ***C10G 11/00*** | (2006.01) |

(52) U.S. Cl.
CPC ..... *C10G 55/06* (2013.01); *C10G 9/007* (2013.01); *C10G 11/00* (2013.01); *C10G 11/06* (2013.01); *C10G 47/34* (2013.01); *C10G 51/02* (2013.01); *C10G 51/026* (2013.01); *C10G 2300/107* (2013.01); *C10G 2300/1077* (2013.01); *C10G 2300/302* (2013.01); *C10G 2400/06* (2013.01); *C10G 2400/16* (2013.01); *C10G 2400/26* (2013.01)

(58) Field of Classification Search
CPC ..... C10G 11/02; C10G 11/06; C10G 2300/1077; C10G 2300/70
See application file for complete search history.

(56) References Cited

U.S. PATENT DOCUMENTS

| | | | | | |
|---|---|---|---|---|---|
| 4,247,387 | A * | 1/1981 | Akbar | C10G 9/04 | 196/111 |
| 4,578,181 | A * | 3/1986 | Derouane | C10G 47/26 | 208/110 |
| 4,615,791 | A * | 10/1986 | Choi | C10G 47/34 | 208/106 |
| 4,770,764 | A * | 9/1988 | Ohtake | C10G 47/02 | 208/108 |
| 5,688,395 | A * | 11/1997 | Carrazza | C10G 47/32 | 208/121 |
| 2005/0258071 | A1* | 11/2005 | Varadaraj | C10G 9/007 | 208/48 AA |

FOREIGN PATENT DOCUMENTS

| | | | | |
|---|---|---|---|---|
| GB | 2 150 150 | | 6/1985 | |
| GB | 2150150 | A * | 6/1985 | C10G 9/16 |

OTHER PUBLICATIONS

International Search Report for PCT/IN2013/000520, mailed Jun. 3, 2014, 5 pages.
Written Opinion of the ISA for PCT/IN2013/000520, mailed Jun. 3, 2014, 7 pages.

* cited by examiner

*Primary Examiner* — Randy Boyer
(74) *Attorney, Agent, or Firm* — Nixon & Vanderhye P.C.

(57) ABSTRACT

The present subject matter provides a process for hydrocarbon residue upgradation. The combination of the hydrocarbon residue along with aromatic rich hydrocarbons, catalysts and surfactants allow the operation of visbreaking unit at higher temperature while producing a stable bottom product.

24 Claims, 1 Drawing Sheet

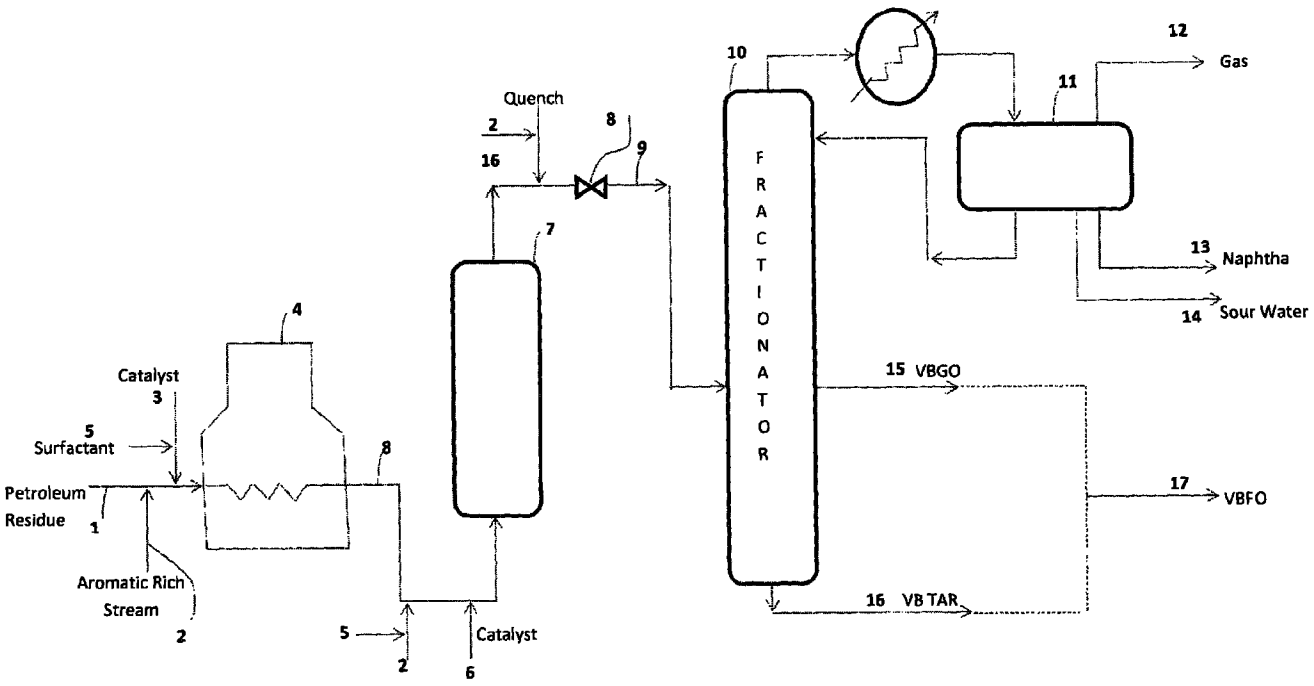
Catalyst
3
5
Surfactant
Petroleum
Residue
1
Aromatic Rich
Stream
2
4
8
5
2
Catalyst
6
7
Quench
2
16
8
9
10
F R A C T I O N A T O R
15 VBGO
16 VB TAR
17 VBFO
11
12 Gas
13 Naphtha
14 Sour Water

HYDROCARBON RESIDUE UPGRADATION PROCESS

This application is the U.S. national phase of International Application No. PCT/IN2013/000520 filed 27 Aug. 2013, which designated the U.S. and claims priority to IN 2029/MUM/2013 filed 14 Jun. 2013, the entire contents of each of which are hereby incorporated by reference.

TECHNICAL FIELD

The subject matter described herein in general relates to visbreaking process. The present disclosure in particular relates to a process for treating of hydrocarbon residue in the presence of aromatic rich hydrocarbon, oil soluble catalyst, water soluble catalyst, surfactant, and water under suitable conditions, to produce petroleum products and sour water.

BACKGROUND

Petroleum residues have high viscosity and pour point that make them unsuitable as fuel in industrial furnaces and refineries. Moreover, the increased domestic and international demands of middle distillates and light fuel oil provide economic incentive to upgrade petroleum residues. Visbreaking, generally, is a non-catalytic petroleum refining process where the objective is to produce lighter products from heavy crude oil.

U.S. Pat. No. 6,540,904 discloses a process for upgradation of petroleum residue using Fe based catalyst along with almost 50% of water. However, the patent does not discuss the stability of the product.

U.S. Pat. No. 4,615,791 discloses a process for carrying out visbreaking operation at higher severity using hydrogen donor solvent for reducing the coke formation and producing a product of reduced viscosity, pour point and sedimentation characteristics.

U.S. Pat. No. 5,057,204 describes a process for increasing severity in visbreaking process using $SeO_2$ as a catalyst, which helps in promoting transfer of hydrogen from residue feed to the portion of the feed having reactive radicals formed during the reaction. This patent does not disclose the use of hydrogen and aromatic rich material, which helps in increasing visbreaking unit severity by enhancing solvency power of the hydrocarbon oil for keeping asphaltenes in dispersed phase.

However, it is not possible to increase the visbreaking unit severity, as beyond a certain severity level, the bottom product from the visbreaking unit i.e. visbroken tar becomes unstable. Therefore, a need is always felt to develop a process, which can substantially increase the conversion in the visbreaking unit without making the visbroken tar unstable.

SUMMARY

The subject matter described herein is directed towards a process for hydrocarbon residue upgradation, the process comprising: mixing hydrocarbon residue with aromatic rich hydrocarbon to obtain a first mixture; contacting the first mixture with a combination of a oil soluble catalyst and a surfactant to obtain a second mixture; heating the second mixture in a furnace at a temperature range of 400-500° C. for a residence time of 1-5 min; treating effluent from the furnace with aromatic rich hydrocarbon and the surfactant to form a third mixture; adding an aqueous solution of a water soluble catalyst to the third mixture to obtain a fourth mixture; subjecting the fourth mixture in a soaking vessel to a pressure in the range of 4-30 kg/cm$^2$ at a temperature in the range of 400-480° C. and a residence time in the range of 10-50 min; and passing effluent from the soaking vessel to fractionating column followed by visbreaking vapour recovery section to obtain gas, naphtha, gas oil, visbroken tar, and sour water.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter

BRIEF DESCRIPTION OF THE DRAWING

The detailed description is described with reference to the accompanying FIGURES. In the FIGURES, the left-most digit(s) of a reference number identifies the FIGURE in which the reference number first appears. The same numbers are used throughout the drawings to reference like features and components.

FIG. 1 graphically illustrates the flow diagram of the residue hydrocarbon upgradation process.

It should be appreciated by those skilled in the art that any block diagrams herein represent conceptual views of illustrative systems embodying the principles of the present subject matter.

DETAILED DESCRIPTION

The present invention now will be described more fully hereinafter. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The subject matter disclosed herein relates to a process for hydrocarbon residue upgradation. It is the main object of the present disclosure to provide a process for visbreaking and delayed coking in petroleum refinery. Another objective of the present disclosure is to increase the conversion in visbreaking process by using water and oil soluble catalysts in combination with water, surfactants and aromatic rich hydrocarbon streams available in refinery. It is further object of the invention is to provide a suitable locations for the injection of catalysts, aromatic rich hydrocarbon stream and surfactants for getting higher conversion with improved stability of the bottom product in visbreaking process.

An embodiment of the present disclosure provides a process for hydrocarbon residue upgradation, the process comprising: mixing hydrocarbon residue with aromatic rich hydrocarbon to obtain a first mixture; contacting the first mixture with a combination of a oil soluble catalyst and a surfactant to obtain a second mixture; heating the second mixture in a furnace at a temperature range of 400-500° C. for a residence time of 1-5 min; treating effluent from the furnace with aromatic rich hydrocarbon and the surfactant to form a third mixture; adding an aqueous solution of a water soluble catalyst to the third mixture to obtain a fourth mixture; subjecting the fourth mixture in a soaking vessel to a pressure in the range of 4-30 kg/cm$^2$ at a temperature in the range of 400-480° C. and a residence time in the range of 10-50 min; and passing effluent from the soaking vessel to fractionating column followed by visbreaking vapour recovery section to obtain gas, naphtha, gas oil, visbroken tar, and sour water.

Another embodiment of the present disclosure provides a process for hydrocarbon residue upgradation wherein the hydrocarbon residue contains Conradson Carbon Residue in excess of 10 wt %. Yet another embodiment of the present disclosure relates to a process for hydrocarbon residue upgradation, wherein the hydrocarbon residue has viscosity in the range of 300-2000 cSt. In still another embodiment of the present disclosure provides a process for hydrocarbon residue upgradation, wherein the hydrocarbon residue is selected from group comprising of atmospheric tower bottom, vacuum tower bottom, extra heavy crude and combinations thereof.

Hydrocarbon oil is a mixture of saturates, aromatics, resin and asphaltene. The asphaltenes are kept in dispersed phase by, resins. However, during visbreaking reaction at higher temperature, resin gets cracked and is not able to keep the asphaltenes in suspended or dissolved in the oil and thus makes the oil unstable.

Aromatic rich hydrocarbon and water donate hydrogen to thermally cracked free radicals (generated during visbreaking reaction conditions) and thereby create cushion in further increasing the reaction temperature without allowing the agglomeration of asphaltenes. Higher aromatic content also increases the solvency power of the hydrocarbon oil to keep the asphaltene in dispersed phase and thus provide a cushion in increasing reaction temperature.

The sources of hydrogen for the visbreaking process are the aromatic rich hydrocarbon and demineralized water. Aromatic rich hydrocarbon is hydro-aromatic solvent having aromatic content >70 wt % and having hydrogen content distribution in $H_{Ar}$ and $H_{alpha}$ where $H_{Ar}$ is at least 20% and $H_{alpha}$ is at least 15% of the total hydrogen content in aromatic rich hydrocarbon. The $H_{Ar}$ protons are directly attached to the aromatic moieties whereas the $H_{alpha}$ protons are attached to non-aromatic carbon directly attached to an aromatic moiety. This hydrogen content distribution is characterized by Nuclear Magnetic Resonance (NMR) spectral analysis.

An embodiment of the present disclosure provides a process for hydrocarbon residue upgradation, wherein the aromatic rich hydrocarbon is hydro-aromatic solvent having more than 70% w/w aromatic content. Yet another embodiment of the present disclosure provides a process for hydrocarbon residue upgradation, wherein the aromatic rich hydrocarbons have at least 20% of aromatic hydrogens and 15% of alpha hydrogens of the total hydrogen content. Another embodiment of the present disclosure relates to a process for hydrocarbon residue upgradation, wherein the aromatic rich hydrocarbon is selected from the group comprising of bottom products from FCC unit, delayed coker unit, naphtha cracker unit, gas cracker unit and combinations thereof. Yet another embodiment of the present disclosure relates to a process for hydrocarbon residue upgradation, wherein the aromatic rich hydrocarbon is in the range of 1 to 25 w/w with respect to the hydrocarbon residue.

The oil soluble catalyst is added to the visbreaking reaction section in powdered form. It may also be added by dissolving the catalyst in oil. The oil soluble catalyst acts as a hydrogenation catalyst which facilitates the transfer of hydrogen from aromatic rich hydrocarbon, hydrocarbon residue, and water. In another embodiment of the present disclosure provides a process for hydrocarbon residue upgradation, wherein the oil soluble catalyst is selected from the group comprising of molybdenum disulfide, molybdenum carbonyl, molyebdenum acetyl acetonate, molybdenum 2-ethyl hexanoate, and mixtures thereof. In yet another embodiment of the present disclosure provides a process for hydrocarbon residue upgradation, wherein the oil soluble catalyst is in the range of 0.001 to 0.5 w/w with respect to the hydrocarbon residue.

The water soluble catalyst may be added in solution form or solid form to the visbreaking reaction section. The water soluble catalyst helps in increasing the pH of the acidic sour water. During visbreaking reaction, aqueous solution of $MgSO_4$ forms magnesium hydroxide ($Mg(OH)_2$) which ionises to increase $OH^-$ ion concentration. This results in the increased pH in sour water and in turn reducing the amount of amines required to neutralize the pH of sour water. Another embodiment of the present disclosure provides a process for hydrocarbon residue upgradation, wherein sour water has a pH of not less than 5.5.

The present disclosure further relates to a process for hydrocarbon residue upgradation, wherein the water soluble catalyst is selected from the group comprising of magnesium sulphate, magnesium chloride, and mixtures thereof. The present disclosure also provides a process for hydrocarbon residue upgradation, wherein the aqueous solution of the water soluble catalyst contains 30-50% w/w water soluble catalyst. An embodiment of the present disclosure also provides a process for hydrocarbon residue upgradation, wherein the aqueous solution of the water soluble catalyst contains 40% w/w water soluble catalyst. Another embodiment of the present disclosure provides a process for hydrocarbon residue upgradation, wherein the water soluble catalyst is in the range of 0.01 to 1% w/w with respect to the hydrocarbon residue.

The use of surfactant not only inhibit the asphaltene precipitation but also effective in dissolving asphaltenes. This result in increasing the operation temperature in visbreaking without making the visbroken tar unstable and delays the decoking requirement of the furnace. Delay in the decoking requirement of the furnace improves furnace run length. Furnace run length is number of days of visbreaking unit operation without necessity for decoking of the furnace.

In yet another embodiment of the present disclosure provides a process for hydrocarbon residue upgradation, wherein the surfactant is selected from the group comprising of synthetic surfactant, bio-surfactant, and mixtures thereof, preferably from the group comprising of dodecyl benzene sulphonic acid, sodium lauryl sulfate, nonyl phenol, dodecyl resorcinol, rhamnolipids, glycolipids, trehalolipids, sophrolipids, and mixtures thereof. In still another embodiment of the present disclosure relates to a process for hydrocarbon residue upgradation, wherein the surfactant is in the range of 0-1000 ppmw with respect to the hydrocarbon residue. In yet another embodiment of the present disclosure relates to a process for hydrocarbon residue upgradation, wherein the surfactant is in the range of 50-200 ppmw with respect to the hydrocarbon residue.

In further embodiment of the present disclosure provides a process for hydrocarbon residue upgradation, wherein the synthetic surfactant is dodecyl benzene sulphonic acid. Another embodiment of the present disclosure relates to a process for hydrocarbon residue upgradation, wherein dodecyl benzene sulphonic acid is 50 ppmw with respect to the hydrocarbon residue.

Another embodiment of the present disclosure provides a process for hydrocarbon residue upgradation, wherein the bio-surfactant is rhamnolipid biosurfactant. Another embodiment of the present disclosure relates to a process for hydrocarbon residue upgradation, wherein biosurfactant acid is 50 ppmw with respect to the hydrocarbon residue.

In accordance to the present disclosure provides a process for hydrocarbon residue upgradation, wherein the oil soluble catalyst, water soluble catalyst, surfactants and aromatic rich hydrocarbon injection can be injected at multiple points so that simultaneous cracking and saturation of free radicals occurs to improve the product stability.

In yet another embodiment of the present disclosure provides a process for hydrocarbon residue upgradation, wherein visbroken tar is obtained in reduced yield and improved stability.

Another embodiment of the present disclosure relates to a process for hydrocarbon residue upgradation, wherein the effluent from the soaking vessel is treated with visbroken tar and aromatic rich hydrocarbon for quenching cracking reaction before passing to the fractionating column.

In further embodiment of the present disclosure provides a process for hydrocarbon residue upgradation, the process comprising: mixing vacuum tower bottom with bottom product from FCC unit to obtain a first mixture; contacting the first mixture with a combination of molybdenum disulfide and rhamnolipid to obtain a second mixture; heating the second mixture in a furnace at a temperature range of 440-460° C. for a residence time of 2-4 min; treating effluent from the furnace with bottom product from FCC unit and dodecyl benzene sulphonic acid to form a third mixture; adding an aqueous solution of magnesium sulphate to the third mixture to obtain a fourth mixture; subjecting the fourth mixture in a soaking vessel to a pressure in the range of 10-15 kg/cm$^2$ g at a temperature in the range of 430-440° C. and a residence time in the range of 20-25 min; and passing effluent from the soaking vessel to fractionating column followed by visbreaking recovery section to obtain gas, naphtha, gas oil, visbroken tar, and sour water.

Another embodiment of the present disclosure provides a process for improved conversion in visbreaking process using catalysts and without using external hydrogen source.

Yet another embodiment of the present disclosure provides a process where conversion in visbreaking is improved by using aqueous solution of water soluble catalysts and aromatic rich hydrocarbon streams available in refinery.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices and materials are described herein.

Example-1

Process Flow for Hydrocarbon Residue Upgradation Process

The petroleum residue used in the present disclosure is vacuum tower bottom (VTB) having Conradson Carbon Residue more than 10 wt % and viscosity in the range of 300-1500 cSt @ 98.9° C. This feed (1) was mixed with the bottom from FCC unit (2). Molybdenum disulfide catalyst (3) was dissolved in stream (2) and injected before the furnace (4). Rhamnolipids (5) was mixed with catalyst (3) and put upstream of the furnace (4). The entire mix was then preheated in the furnace at the temperature range of 400-500° C. The effluent from the furnace was then mixed with aromatic rich stream (2) along with Dodecyl benzene sulphonic Acid (5) followed by addition of aqueous solution of magnesium suphate (6). The entire material was then transferred to the soaking vessel (7). The soaking vessel temperature was nearly 10-30° C. lower than the furnace. The soaking vessel pressure was kept in the range of 4-30 kg/cm$^2$ using the back pressure control valve (8). The effluent coming from the soaking vessel was quenched with mixture of bottom recycle product from visbreaking unit (16) and aromatic rich hydrocarbon (2) so as to lower the effluent temperature below the cracking temperature. This helped in lowering free radical formation. The material was then sent to fractionator (10) through the transfer line (9) and then to vapor recovery section having reflux drum (11) for getting different products like gas (12), naphtha (13), sour water (14), gas oil (15) and visbroken tar (16). Visbroken tar was mixed with gas oil and the mixed stream is visbroken fuel oil (VBFO) (17). VBFO was tested for the stability analysis using the P-Value test as per the ASTM method ASTM D-7060. VBFO sample was considered as stable only if P-value is more than 1.05.

Example-2

Effect of Severity on Conversion and Stability Using Conventional Visbreaking Process This example illustrates the effect of temperature on conversion and product stability using VTB as the feedstock. These experiments were conducted in laboratory scale batch reactor, which closely simulated a commercial visbreaking unit. The product yields i.e. 150-, 150-350 and 350+ fractions were calculated using the Gas Chromatography data obtained from high temperature SimDis Analyzer. The liquid products obtained from the experiments were put under vacuum to get the 150+ fraction for which viscosity and P-value tests were conducted. The properties of the feed-A used during these experiments are given below:

TABLE 1

| Parameters | Unit | Feed-A |
|---|---|---|
| Density | Kg/m$^3$ | 1.022 |
| Viscosity@ 98.9° C. | cSt | 900 |
| CCR | Wt % | 20 |
| Simulated Distillation | | |
| IBP | ° C. | 350 |
| 10% | ° C. | 420 |
| 30% | ° C. | 470 |
| 50% | ° C. | 490 |
| 70% | ° C. | 520 |
| 90% | ° C. | 570 |

The effect of temperature on product yield and stability of 150+ fraction using feed-A is indicated below in Table-2

TABLE 2

| Parameters | Unit | Run#1 | Run#2 | Run#3 | Run#4 | Run#5 |
|---|---|---|---|---|---|---|
| Temperature | ° C. | 406 | 413 | 416 | 418 | 421 |
| Pressure | Kg/cm$^2$ | 10 | 10 | 10 | 10 | 10 |
| Residence time | mins | 15 | 15 | 15 | 15 | 15 |
| 150– (Product Yield) | wt % | 3.1 | 3.6 | 4.2 | 4.5 | 5.9 |
| 150-350 (Product Yield) | wt % | 5.9 | 7.3 | 9.0 | 9.6 | 10.6 |

TABLE 2-continued

| Parameters | Unit | Run#1 | Run#2 | Run#3 | Run#4 | Run#5 |
|---|---|---|---|---|---|---|
| 350+ (Product Yield) | wt % | 91.0 | 89.1 | 86.7 | 85.9 | 83.2 |
| P-Value | wt % | 1.20 | 1.15 | 1.10 | 1.05 | 1.00 |
| Viscosity | cSt | 200 | 131 | 93 | 80 | 68 |

From Table-2 it can be observed that with increase in reaction temperature, yield of 350+ fraction and stability of 150+ fraction decreases. However, the conversion of fractions below 350 increases. Also, beyond 418° C., the liquid product becomes unstable as seen from P-Value data.

Example-3

Effect on Conversion and Stability

This example illustrates the effect of catalysts on the conversion of the feed, which is mixture of residue hydrocarbon and aromatic rich hydrocarbon in the ratio of 80:20 (wt/wt). The experiments using the combined feed were conducted in laboratory scale batch reactor. The liquid product obtained after the batch experiments were distilled under vacuum to get the 150+ fraction. The feed quality data used for the experiments are shown below in Table 3:

TABLE 3

| Parameters | Unit | Residue Hydrocarbon | Aromatic Rich Hydrocarbon |
|---|---|---|---|
| Density | $Kg/m^3$ | 1.062 | 1.010 |
| Viscosity@ 98.9° C. | cSt | 1000 | 5 |
| CCR | Wt % | 25 | 10 |
| Simulated Distillation | | | |
| IBP | ° C. | 350 | 280 |
| 10% | ° C. | 420 | 386 |
| 30% | ° C. | 470 | 411 |
| 50% | ° C. | 490 | 427 |
| 70% | ° C. | 520 | 449 |
| 90% | ° C. | 570 | — |

The operating conditions and the product yield and quality data are shown below in Table 4:

TABLE 4

| Parameters | Unit | Run#1 | Run#2 |
|---|---|---|---|
| Oil soluble Catalyst | % | 0 | 0.2 |
| Water soluble Catalyst | % | 0 | 0.5 |
| DBSA | ppmw | 0 | 50 |
| Bio-Surfactant | ppmw | 0 | 50 |
| Water | % | 2 | 2 |
| Temperature | ° C. | 410 | 415 |
| Pressure | $Kg/cm^2$ | 20 | 20 |
| 150− (Product Yield) | wt % | 1.8 | 3.0 |
| 150-350 (Product Yield) | wt % | 11.9 | 13.2 |
| 350+ (Product Yield) | wt % | 86.3 | 83.8 |
| P-Value | wt % | 1.05 | 1.10 |
| Viscosity | cSt | 100 | 70 |

The above example shows the crackability of the feed is limited by P-value of 150+ fractions. By heating the feed in presence of catalysts, surfactants and water, the conversion (i.e. yield of 350− fraction) increases while producing the 150+ fractions with higher P-value.

Example-4

Effect of Cracking on Product Yield and Quality Using Present Invention Vis-à-Vis Conventional Visbreaking Process Tests were conducted in commercial visbreaker unit using the catalysts of present invention. Petroleum residue used for the test was having feed viscosity of 600 cSt @ 98.9° C. Oil soluble catalyst was added along with feed before the furnace and water soluble catalyst was injected in the transfer line between furnace and soaker. Surfactants were added along with fresh feed. The aromatic rich stream was added at multiple points viz along with feed, in the transfer line from furnace to soaker and in the soaker quench. The plant operating conditions and the results are shown below in Table 5:

TABLE 5

| Parameters | Unit | Conventional Visbreaking Process | Visbreaking Process using present invention |
|---|---|---|---|
| Petroleum Residue | m3/hr | 90 | 80 |
| Aromatic rich stream | % | 0 | 10 |
| Furnace Outlet Temp | ° C. | 438 | 446 |
| Soaker Outlet Pressure | $kg/cm^2$ | 12 | 12 |
| Oil soluble Catalyst | % | 0 | 0.1 |
| Water soluble catalyst | % | 0 | 0.2 |
| Surfactant | ppmw | 0 | 100 |
| Product Yield, wt % | | | |
| Gas | | 1.05 | 1.18 |
| Naphtha | | 2.67 | 2.11 |
| Gas Oil | | 3.29 | 8.15 |
| Visbroken Tar | | 93.09 | 88.57 |
| Stability of VBFO | | 1.05 | 1.10 |
| Viscosity of VBFO | cSt | 60 | 25 |
| Furnace Pressure drop | $kg/cm^2$ | 8.3 | 7.8 |
| pH of Sour Water | | 5.0 | 5.5 |

VBFO is mix of Gas Oil and Visbroken Tar. The stability of VBFO sample was measured using P-Value test method (ASTM D-7060). VBFO sample having P-Value ≥1.05 is considered to be stable. The above example shows the effect of catalyst in increasing the conversion and stability of the VBFO product. It is also seen that the pressure drop across the furnace decreases after using the process/catalyst of present invention. By use of the catalyst of present invention, the pH of sour water is increased from 5.0 to 5.5.

Although the subject matter has been described in considerable detail with reference to certain preferred embodiments thereof, other embodiments are possible. As such, the spirit and scope of the appended claims should not be limited to the description of the preferred embodiment contained therein.

We claim:

1. A process for hydrocarbon residue upgradation, the process comprising:

(a) mixing hydrocarbon residue with aromatic rich hydrocarbon to obtain a first mixture;

(b) contacting the first mixture with a combination of a oil soluble catalyst and a surfactant to obtain a second mixture;

(c) heating the second mixture in a furnace at a temperature range of 400-500° C. for a residence time of 1-5 min;

(d) treating effluent from the furnace with aromatic rich hydrocarbon and the surfactant to form a third mixture;

(e) adding an aqueous solution of a water soluble catalyst to the third mixture to obtain a fourth mixture;

(f) subjecting the fourth mixture in a soaking vessel to a pressure in the range of 4-30 kg/cm' at a temperature in the range of 400-480° C. and a residence time in the range of 10-50 min; and (g) passing effluent from the soaking vessel to fractionating column followed by visbreaking vapour recovery section to obtain gas, naphtha, gas oil, visbroken tar, and sour water.

2. The process as claimed in claim 1, wherein the hydrocarbon residue contains Conradson Carbon Residue in excess of 10 wt %.

3. The process as claimed in claim 1, wherein the hydrocarbon residue has viscosity in the range of 300-2000 cSt.

4. The process as claimed in claim 1, wherein the hydrocarbon residue is selected from group comprising of atmospheric tower bottom, vacuum tower bottom, extra heavy crude and combinations thereof.

5. The process as claimed in claim 1, wherein the aromatic rich hydrocarbon is hydro-aromatic solvent having more than 70% w/w aromatic content.

6. The process as claimed in claim 1, wherein the aromatic rich hydrocarbon have at least 20% of aromatic hydrogens and 15% of alpha hydrogens of the total hydrogen content.

7. The process as claimed in claim 1, wherein the aromatic rich hydrocarbon is selected from the group comprising of bottom products from FCC unit, delayed coker unit, naphtha cracker unit, gas cracker unit and combinations thereof.

8. A process as claimed in claim 1, wherein the aromatic rich hydrocarbon is in the range of 1 to 25 w/w with respect to the hydrocarbon residue.

9. A process as claimed in claim 1, wherein the oil soluble catalyst is selected from the group comprising of molybdenum disulfide, molybdenum carbonyl, molyebdenum acetyl acetonate, molybdenum 2-ethyl hexanoate, and mixtures thereof.

10. A process as claimed in claim 1, wherein the oil soluble catalyst is in the range of 0.001 to 0.5 w/w with respect to the hydrocarbon residue.

11. A process as claimed in claim 1, wherein the water soluble catalyst is selected from the group comprising of magnesium sulphate, magnesium chloride, and mixtures thereof.

12. A process as claimed in claim 1, wherein the aqueous solution of the water soluble catalyst contains 30-50% w/w water soluble catalyst.

13. A process as claimed in claim 1, wherein the aqueous solution of the water soluble catalyst contains 40% w/w water soluble catalyst.

14. A process as claimed in claim 1, wherein the water soluble catalyst is in the range of 0.01 to 1% w/w with respect to the hydrocarbon residue.

15. A process as claimed in claim 1, wherein the surfactant is selected from the group comprising of synthetic surfactant, bio-surfactant, and mixtures thereof.

16. A process as claimed in claim 1, wherein the surfactant is in the range of 0-1000 ppmw with respect to the hydrocarbon residue.

17. A process as claimed in claim 15, wherein the synthetic surfactant is dodecyl benzene sulphonic acid.

18. A process as claimed in claim 15, wherein the biosurfactant is rhamnolipid biosurfactant.

19. A process as claimed in claim 1, wherein the oil soluble catalyst, water soluble catalyst, surfactants and aromatic rich hydrocarbon injection can be injected at multiple points so that simultaneous cracking and saturation of free radicals occurs.

20. A process as claimed in claim 1, wherein sour water has a pH of not less than 5.5.

21. A process as claimed in claim 1, wherein visbroken tar is obtained in reduced yield.

22. A process as claimed in claim 1, wherein the effluent from the soaking vessel is treated with visbroken tar and aromatic rich hydrocarbon for quenching cracking reaction before passing to the fractionating column.

23. A process for hydrocarbon residue upgradation, the process comprising:

(a) mixing vacuum tower bottom with bottom product from FCC unit to obtain a first mixture;

(b) contacting the first mixture with a combination of molybdenum disulfide and rhamnolipid to obtain a second mixture;

(c) heating the second mixture in a furnace at a temperature range of 440-460° C. for a residence time of 2-4 min;

(d) treating effluent from the furnace with bottom product from FCC unit and dodecyl benzene sulphonic acid to form a third mixture;

(e) adding an aqueous solution of magnesium sulphate to the third mixture to obtain a fourth mixture;

(f) subjecting the fourth mixture in a soaking vessel to a pressure in the range of 10-15 kg/cm' at a temperature in the range of 430-440° C. and a residence time in the range of 20-25 min; and (g) passing effluent from the soaking vessel to fractionating column followed by visbreaking recovery section to obtain gas, naphtha, gas oil, Visbroken tar, and sour water.

24. A process as claimed in claim 1, wherein the surfactant comprises material selected from the group consisting of dodecyl benzene sulphonic acid, sodium lauryl sulfate, nonyl phenol, dodecyl resorcinol, rhamnolipids, glycolipids, trehalolipids, sophrolipids, and mixtures thereof.

* * * * *